US005337826A

United States Patent [19]

Barrington

[11] Patent Number: 5,337,826

[45] Date of Patent: Aug. 16, 1994

[54] TESTER VALVE

[75] Inventor: Burchus Q. Barrington, Duncan, Okla.

[73] Assignee: Halliburton Company, Houston, Tex.

[21] Appl. No.: 25,793

[22] Filed: Mar. 3, 1993

Related U.S. Application Data

[62] Division of Ser. No. 821,516, Jan. 14, 1992, Pat. No. 5,228,516.

[51] Int. Cl.[5] ..... E21B 34/06

[52] U.S. Cl. ..... 166/319; 166/332; 267/141.3

[58] Field of Search ..... 166/316, 319, 321, 332, 166/334; 175/321; 267/141.3, 141.2

[56] References Cited

U.S. PATENT DOCUMENTS 4,063,593 12/1977 Jessup ..... 166/317
4,064,937 12/1977 Barrington ..... 166/321 X
4,185,690 1/1980 Kinney ..... 166/319 X
4,618,000 10/1986 Burris, II ..... 166/373
5,183,113 2/1993 Leaney et al. ..... 166/316

FOREIGN PATENT DOCUMENTS 347428 8/1972 U.S.S.R. ..... 175/321
1555462 4/1990 U.S.S.R. ..... 175/321

*Primary Examiner*—Hoang C. Dang
*Attorney, Agent, or Firm*—Tracy W. Druce; Lucian Wayne Beavers

[57] ABSTRACT

A reciprocating full flow tester valve is provided with a shock absorber and tolerance adjustment device for absorbing an impact between a power mandrel of the tool and an operating assembly of the tool. An improved hydraulic impedance system is also provided for providing a time delay in telescopingly collapsing movement of the tool when weight is set down on the tool to open the tester valve.

6 Claims, 6 Drawing Sheets

TESTER VALVE

This is a divisional of copending application Ser. No. 07/821,516 filed on Jan. 14, 1992, now the U.S. Pat. No. 5,228,516.

BACKGROUND OF THE INVENTION

1. Field Of The Invention

The present invention relates generally to downhole tools for use in wells, and more particularly, but not by way of limitation, to improvements in a downhole tester valve.

2. Description Of The Prior Art

During the course of drilling an oil well, one operation which is often performed is to lower a testing string into the well to test the production capabilities of the hydrocarbon producing underground formations intersected by the well. This testing is accomplished by lowering a string of pipe, commonly referred to as a drill pipe, into the well with the formation tester valve attached to the lower end of the string of pipe and oriented in a closed position, and with a packer attached below the formation tester valve. This string of the pipe with the attached testing equipment is generally referred to as a well test string. The basic components of a typical well test string are seen for example in FIG. 1 of U.S. Pat. No. 4,295,361 to McMahan, the details of which are incorporated herein by reference.

Once the test string is lowered to the desired final position, the packer means is set to seal off the annulus between the test string and the well casing, and the formation tester valve is opened to allow the underground formation to produce through the test string.

One example of such a tester valve is that shown in U.S. Pat. Nos. 4,579,174; 4,582,140; and 4,624,317, all to Barrington and all assigned to the assignee of the present invention.

The operation of these tools involves a telescoping action between two portions of the tool which serves to open the tester valve when weight is set down on the tool after the packer has been set in the well below the tool. This telescoping action occurs relatively slowly due to a hydraulic time delay built into the tool. The purpose of this time delay is to allow the formation tester valve to transmit compressional hydraulic forces for relatively short periods of time without actuating the valve, and to transmit weight through its hydraulic impedance system to apply drill pipe weight to the packer below. This is necessary for a number of reasons. For example, when the well test string is being run into the well bore, the test string often encounters obstructions in the well bore and weight must be set down on the test string for a short period of time in order to push the test string past these obstructions. Also, once the test string is in its desired location, various tools located below the formation tester valve, such as for example the packer, often are designed to be set by lowering drill pipe weight on the test string. The packer must seal against the well bore before the tester valve opens, and this is assured by the time delay built into the telescoping action of the tool.

Thus, it has been found desirable to provide such formation tester valves with a hydraulic time delay device which requires that sufficient weight be set down on the formation tester valve for a sufficient period of time, on the order of several minutes, before the formation tester valve will actually open.

Also, the hydraulic time delay device has been constructed so that the final portion of telescoping motion will occur very rapidly thus jiggling the drill pipe at the surface and providing a positive indication to personnel operating the well that the tester valve is open to begin the flow test of the hydrocarbon producing zone of the well.

SUMMARY OF THE INVENTION

The present invention is directed to various improvements in such tester valves, and particularly to improvements in the hydraulic time delay system and in a shock absorber means for absorbing the impact during the final rapid movement of the tool as the tester valve is opened.

The improvements in the hydraulic time delay system involve a well tool apparatus having a housing with an operating assembly, e.g., a spherical tester valve, disposed therein. A power mandrel is slidably received in the housing and adapted to be selectively telescoped between first and second positions relative to the housing to manipulate the operating assembly. The mandrel is spaced radially inward from a seal bore of the housing to define a longitudinally extending annular metering chamber therebetween.

An annular metering piston is fixedly attached to the power mandrel and divides the metering chamber into first and second portions. The metering piston has a fluid passage disposed therethrough joining the first and second portions, and has flow impedance means disposed in said fluid passage.

A one-way O-ring seal means is disposed about the metering piston for sealing between the metering piston and the housing seal bore when the power mandrel slides in a first direction relative to the seal bore so that fluid from said first portion of said metering chamber must flow through said fluid passage to said second portion of said metering chamber. The one-way O-ring seal means also provides an annular bypass between the metering piston and the housing seal bore when the power mandrel slides in a second direction opposite said first direction relative to said housing.

A dump passage means is defined in the housing for dumping fluid from the first portion of the metering chamber to the second portion of the metering chamber after the metering piston has moved in the first direction past a predetermined position relative to the housing. This allows the rapid final telescoping movement of the tool as the tester valve is opened.

In a second aspect the invention includes a combination shock absorber means and tolerance adjuster which is located between the operating assembly and the power mandrel for absorbing an impact of the power mandrel against the operating assembly during the opening motion of the tester valve.

The shock absorber includes an inner sleeve having a cylindrical outer surface and an outer sleeve slidable relative to the inner sleeve and having a cylindrical inner surface concentrically disposed about and radially spaced from the cylindrical outer surface of the inner sleeve to define an annular chamber therebetween.

The inner and outer sleeves have first and second longitudinally facing shoulders, respectively, facing toward each other to define opposite longitudinal ends of the annular chamber. The chamber has a constant radial thickness defined by the radial spacing between the cylindrical inner surface and cylindrical outer surface, and the chamber has a variable length defined by a longitudinal distance between the first and second shoulders.

An elastomeric shock absorber ring is disposed in the chamber and has a volume less than a volume of the chamber when the longitudinal distance between the first and second shoulders is such that the elastomeric shock absorber ring initially contacts both the first and second shoulders.

The inner and outer sleeves have sufficient possible travel relative to each other such that a closing motion between the first and second sleeves is limited when the volume of the chamber is equal to the volume of the elastomeric shock absorber ring so that the elastomeric shock absorber ring completely fills the chamber thus resiliently terminates the closing motion and absorbs the impact between the mandrel and the operating assembly.

Numerous objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS

The Housing

Figure 1A:
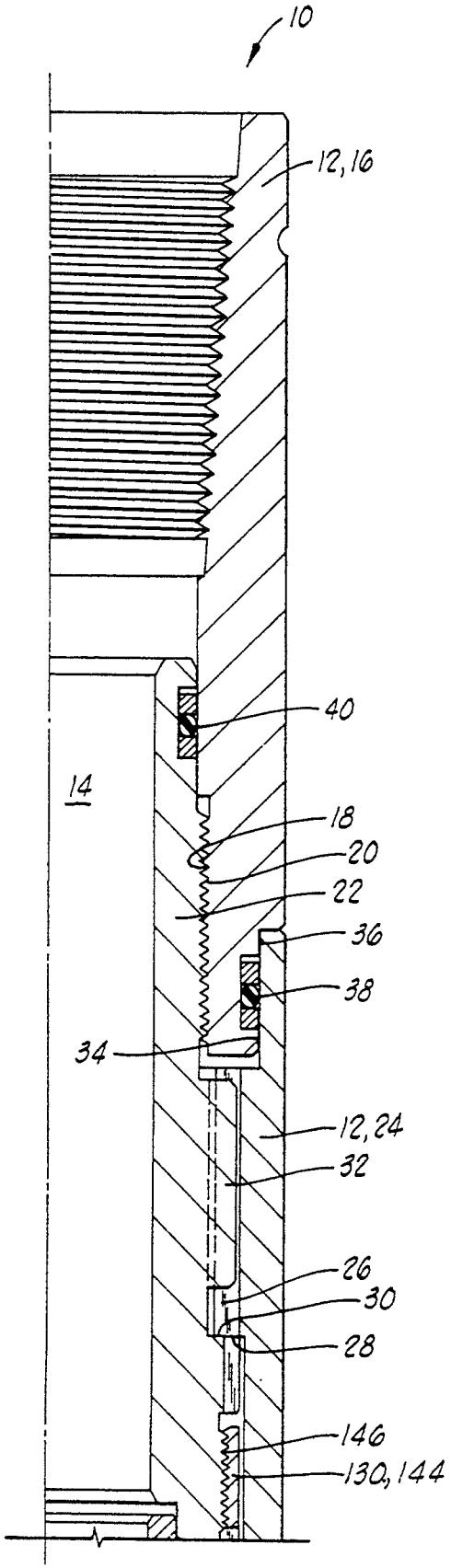
FIGS. 1A–1J comprise an elevation right side only sectioned view of a tester valve.

Referring now to the drawings, and particularly to FIGS. 1A–1J, the well testing tool of the present invention is shown and generally designated by the numeral 10.

The tool 10 includes a housing means generally designated by the numeral 12 which is adapted to be connected in a well test string (not shown) and which has a substantially open bore 14 therethrough.

The housing 12 includes a number of generally cylindrically shaped tubular elements threadedly connected together as illustrated in the drawings.

Housing 12 includes an upper adapter 16 having a lower internal threaded surface 18 threadedly engaged with an external threaded surface 20 of an upper end of upper inner housing mandrel 22 of housing 12.

Housing 12 further includes an outer case 24, the upper portion of which is concentrically received about a lower portion of upper inner housing mandrel 22 which extends below upper adapter 16.

Outer case 24 includes a plurality of radially inwardly directed splines 26. The splines 26 mesh with a plurality of radially outward directed splines 32 of upper inner housing mandrel 22 to prevent relative rotation therebetween.

An uppermost end of case 24 above splines 26 has a cylindrical inner surface 34 which is closely received about a cylindrical outer surface 36 of upper adapter 16, with a seal being provided therebetween by resilient O-ring seal means 38.

A seal is provided between upper inner housing mandrel 22 and upper adapter 16 by resilient O-ring seal 40.

The outer case 24 is held in place relative to upper adapter 16 and upper inner housing mandrel 22 by an upward facing annular shoulder 30 of upper inner housing mandrel 22 which engages a lower end 28 of splines 26.

Case 24 has an internally threaded cylindrical surface 42 near its lower end which is threadedly connected to an externally threaded cylindrical surface 44 of an upper portion of an intermediate housing adapter 46 of the housing 12. A seal is provided therebetween by resilient O-rings 48.

Intermediate housing adapter 46 is threadedly connected at 50 to an upper fill port adapter 47 of housing 12, with a seal being provided therebetween by resilient O-ring 49.

Upper fill port adapter 47 has an upper fill port 52 disposed through a wall thereof which is closed by sealed threaded plug 54.

Upper fill port adapter 47 is connected at thread 56 to the upper end of a metering chamber case 58 of housing 12. A seal is provided therebetween by O-rings 60.

Metering chamber case 58 is connected at its lower end to a lower fill port adapter 62 of housing 12. There is a threaded connection 64 therebetween with O-ring seals 66 sealing therebetween. The lower fill port adapter 62 has an upper extension sleeve 68 threadedly connected thereto at 70 with O-ring seals 72 therebetween. As further described below, the upper extension sleeve 68 of housing 12 cooperates with the metering piston.

Lower fill port adapter 62 has a lower fill port 74 disposed through a wall thereof and closed by a threaded sealed plug 76.

A lower equalizing case 78 of housing 12 is connected to lower fill port adapter 62 at thread 80 with a seal being provided therebetween by O-rings 82.

Lower equalizing case 78 includes a radially inward protruding decreased internal diameter portion 84 which has an equalizing port 86 disposed therethrough.

Lower equalizing case 78 has its lower end connected to a lug case 90 of housing 12 at thread 92 with O-ring seal 94 being provided therebetween. Lug case 90 is connected at its lower end to a lower housing case 96 of housing 12 at thread 98 with O-ring seals 100 being provided therebetween.

The Tester Valve Operating Assembly

Disposed within the outer case 24 of housing 12 is a valve assembly 102 which may also be more generally referred to as part of an operating assembly 102. The valve assembly 102 includes a spherical valve member 104 having a substantially open valve bore 106 therethrough. Upper and lower annular seats 108 and 110 engage the spherical valve member 104.

Figure 1B:
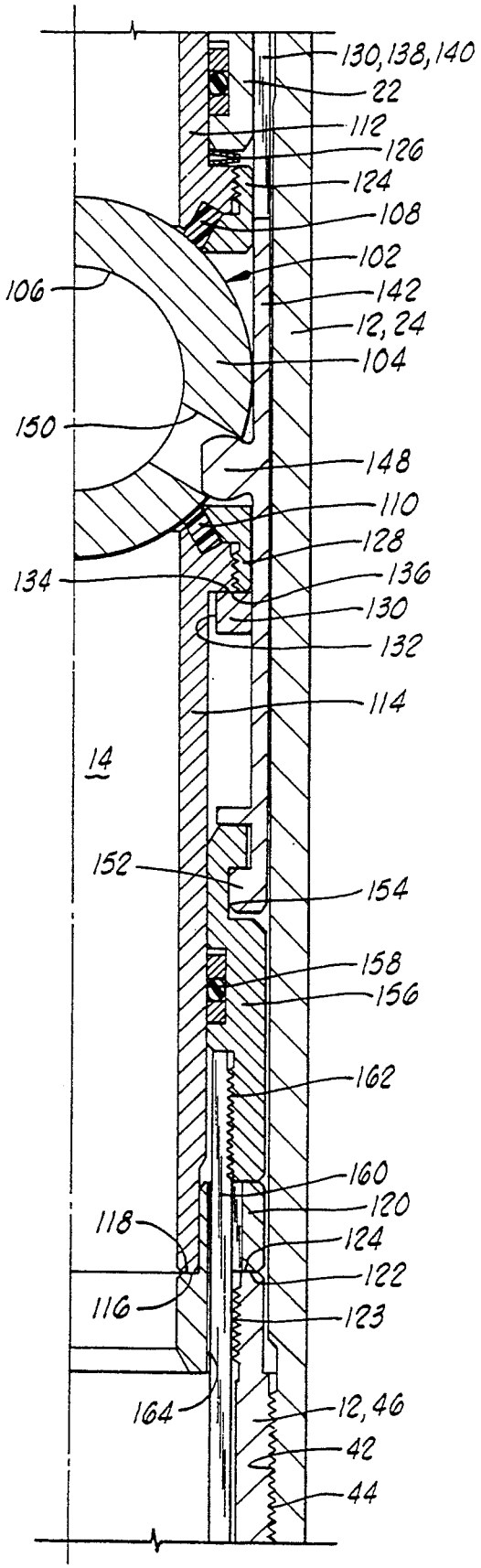

The spherical valve member 104 is rotatable within the seat 108 and 110 between a closed position as illustrated in FIG. 1B wherein the spherical valve member 104 closes housing bore 14 and an open position wherein the spherical valve member 104 is rotated to a position wherein valve bore 106 is aligned with housing bore 14.

An upper load transfer mandrel 112 is disposed between upper annular seat 108 and housing 12 for transferring an upward force caused by an upwardly directed pressure differential across the spherical valve member 104 to the housing 12 by compressional loading of the upper load transfer mandrel 112.

Similarly, a lower load transfer mandrel 114 is disposed between lower annular seat 110 and intermediate housing adapter 46 for transferring a downward force caused by a downwardly directed pressure differential across the spherical valve member 104 to the housing 12 by compressional loading of the lower load transfer mandrel 114. A lower end 116 of lower load transfer mandrel 114 rests upon an upward facing shoulder 118 of an annular collar 120 which is connected at thread 123 to the intermediate housing adapter 46.

Upper seat 108 is held in place against upper load transfer mandrel 112 by a seat retaining ring 124. A Belleville spring 126 is located between upper load transfer mandrel 112 and upper inner housing mandrel 22.

Similarly, lower annular seat 110 is held in place relative to lower load transfer mandrel 114 by a retainer ring 128.

The lower load transfer mandrel 114, lower retaining ring 128, lower annular seat 110, spherical valve member 104, upper annular seat 108, upper retaining ring 124, and upper load transfer mandrel 112 are held together by a cylindrical valve retaining cage 130. The cage 130 has a bore 132 through its lower end through which the lower load transfer mandrel 114 is received. Cage 130 includes an upward facing shoulder 134 which abuts a downward facing shoulder 136 of lower load transfer mandrel 114. Cage 130 includes an intermediate cylindrical cage portion 138 surrounding spherical valve member 104 and having a pair of longitudinally extending recesses 140 in an exterior thereof for slidably receiving a pair of actuating arms 142 as is further described below. Cage 130 includes an upper end 144 which is threadedly connected to upper inner housing mandrel 22 at threaded connection 146.

There are two of the actuating arms 142, each having a lug 148 received in one of two eccentric radial bores 150 of the ball valve element 104. When the housing 12 is moved downward relative to the actuating arms 142, the arms 142 will rotate the ball valve element 104 to its open position.

Lower ends of the actuating arms 142 include radially inward extending flanges 152 received in a groove 154 of an annular ring 156 which is slidably received about the lower load transfer mandrel 114 with an O-ring seal 158 being provided therebetween.

A plurality of actuating fingers 160 are connected to ring 156 at threads 162. Each of the fingers 160 extends upward through a corresponding vertical slot 164 cut through the collar 120. The actuating fingers 160 are integrally formed with and extend upward from an upper operating mandrel 166. The upper operating mandrel 166 is connected to a lower operating mandrel 168 of threaded connection 170. A lower operating mandrel cap 172 is threadedly connected to lower operating mandrel 168 at thread 174.

The Power Mandrel Assembly

A power mandrel assembly 176 is generally slidably received within housing 12 and is adapted to be selectively telescoped between first and second positions relative to housing 12 to rotate the spherical valve member 104 between its closed and open positions.

Power mandrel assembly 176 includes a lower adapter 178 (see FIG. 1J) having a lower external threaded pin end 180 for connection thereof to a conventional pipe string or some adjacent tool such as a packer which may be located below the well testing tool 10.

As seen in FIGS. 1C–1J, the longitudinal bore 14, which may also be referred to a flow passage 14, extends through the various members of the power mandrel assembly 176.

Lower adapter 178 is connected to the lower end of a lower power mandrel 182 of power mandrel assembly 176 at threaded connection 184 with a seal being provided therebetween by O-rings 186. A bypass port 188 is disposed through the side wall of lower power mandrel 182.

Lower power mandrel 182 has a cylindrical outer surface 190 which is closely received within a cylindrical inner surface 192 of lower housing case 96 with a sliding seal being provided therebetween by O-rings 194.

Figure 1C:
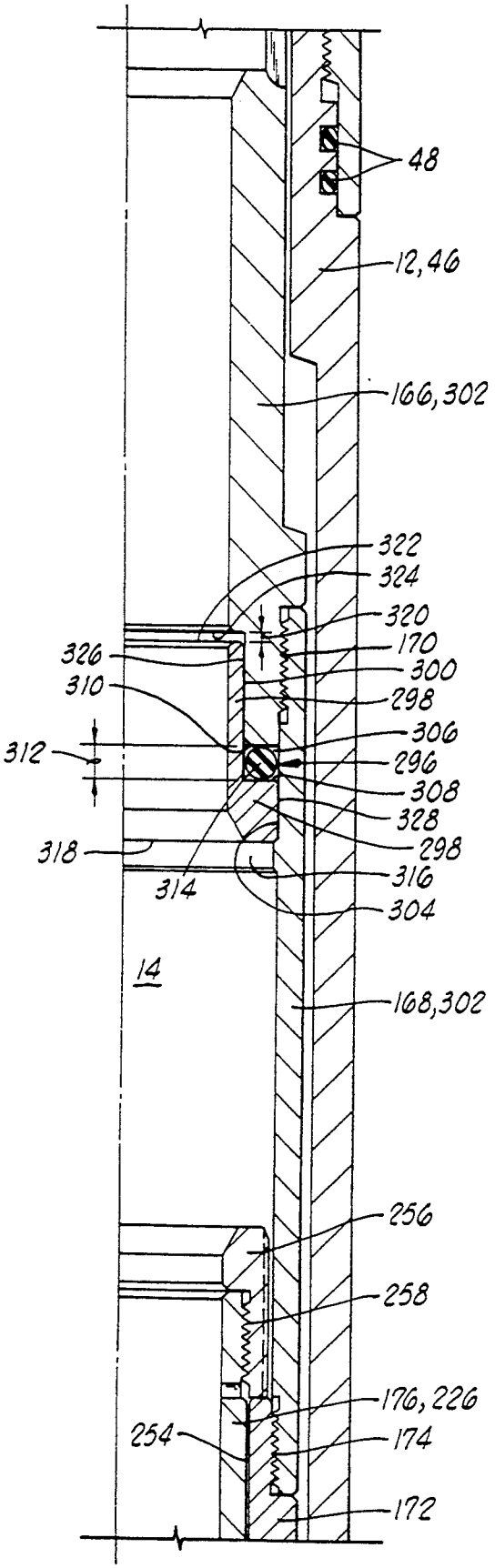
Figure 1D:
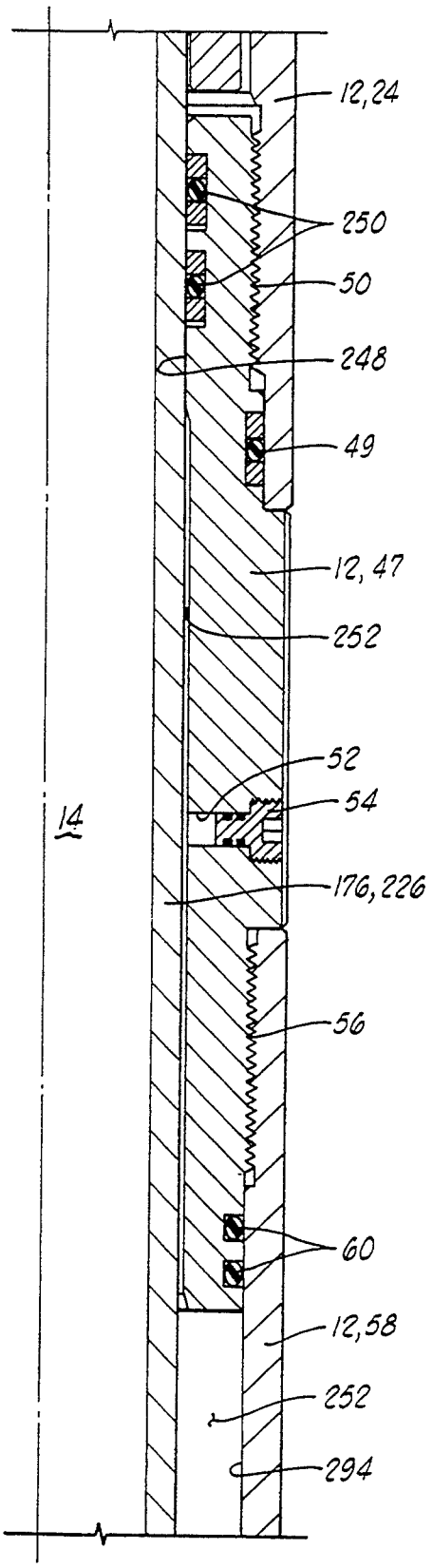
Figure 1E:
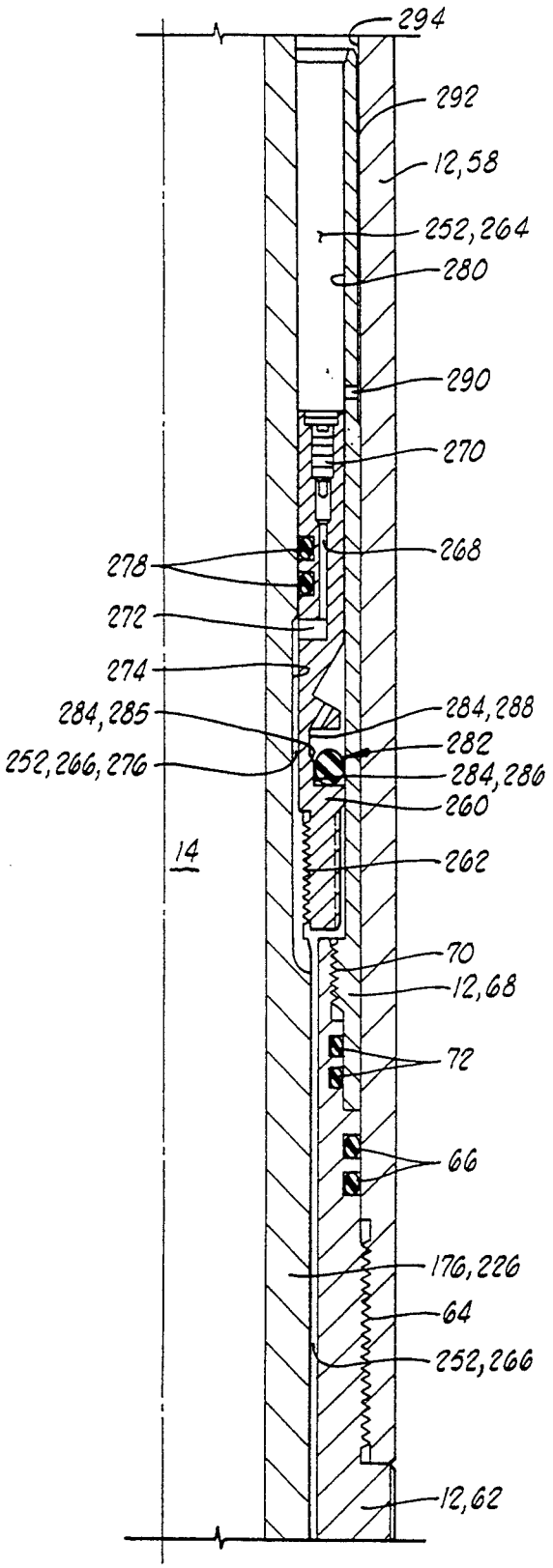
Figure 1F:
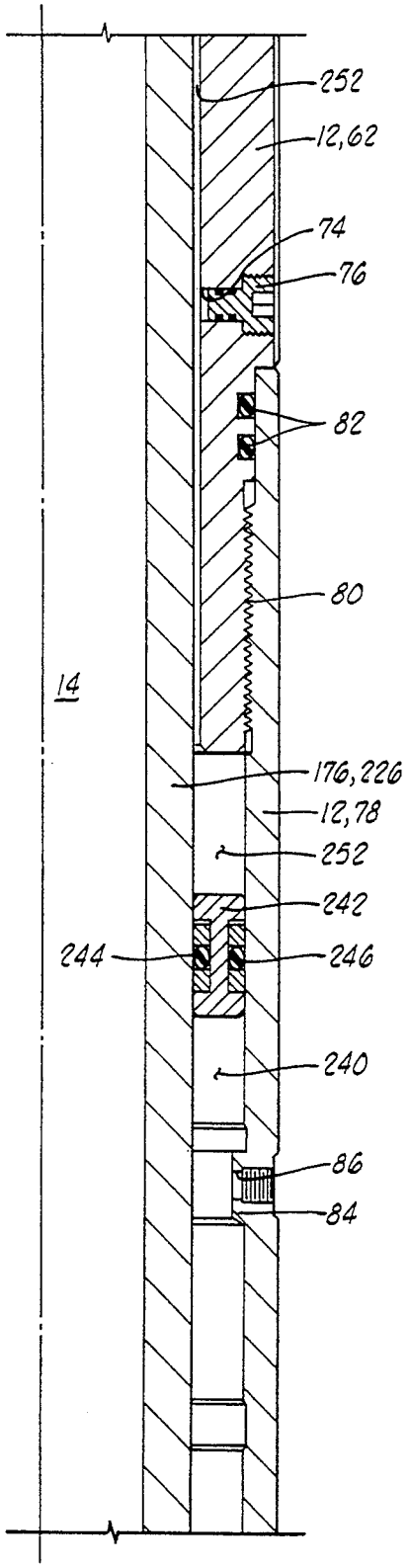
Figure 1G:
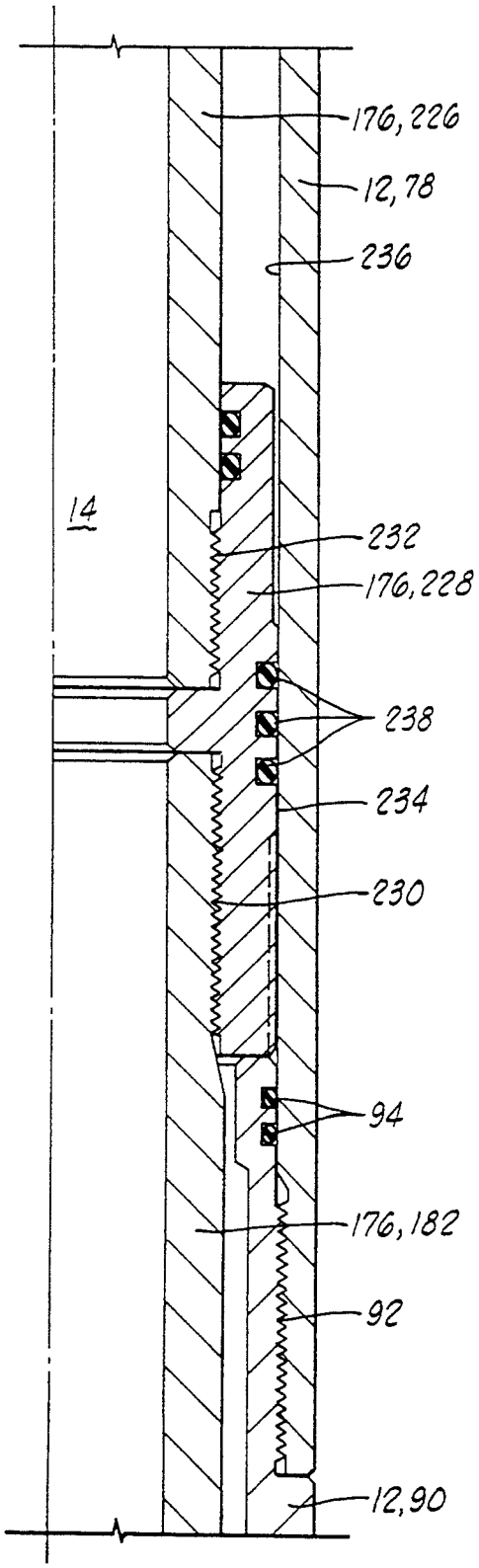

A bypass sleeve 196 is also closely received about outer surface 190 of lower power mandrel 182 and has upper and lower sliding O-ring seals 198 and 200, respectively, therebetween. The bypass sleeve 196 is shown in FIG. 1I as being attached to the lower housing case 96 by a set screw 202 received in a groove 204 of lower housing case 96. It will be appreciated that when the housing 12 moves downward relative to the power mandrel assembly 176 the lower seals 200 will move below bypass port 188 to close port 188. A lower end 206 of bypass sleeve 196 fits within a recess 208 in the upper end of lower adapter 178. With the arrangement shown in FIGS. 1I–1J, the bypass port 188 will be in an open position when the spherical valve member 104 is in its closed position and the bypass port 188 will be closed when the spherical valve member 104 is moved to its open position.

The tester tool 10 is normally run into the well with the spherical valve member 104 in its closed position as shown. A packer (not shown) is located immediately below tool 10 and fits rather closely within the inner surface of the well. It is desirable to have a bypass means for allowing fluid in the flow passage 14 below the closed spherical valve member 104 to bypass the packer thus preventing a piston type effect opposing downward motion of the test string into the well. The bypass port 188 when open allows flow from the lower portion of passage 14 outward through bypass port 118 into a well annulus which surrounds the tool 10 above the packer.

When drill pipe weight is set down to set the packer, the bypass valve will be held open by the time delay action until after the packer is set. This allows the packer to be set without any differential pressure thereacross in the well annulus. After the packer is set, the bypass port 188 will be closed. After the bypass port 188 closes, the ball valve element 104 opens.

It will be apparent that alternatively the set screw 202 could be removed and the bypass sleeve 196 could be attached to lower adapter 178 with a set screw (not shown) set in threaded bore 210 of lower adapter 178 and received within a lower groove 212 of bypass sleeve 196. With that alternative arrangement, the bypass port 188 will always be closed.

As a third alternative, the bypass sleeve 196 can be initially positioned as shown in FIG. 1I, but the set screw 202 can be removed so that once the housing 12 moves downward relative to power mandrel assembly 176, the bypass sleeve 196 will cover bypass port 188. Subsequently, upon moving housing 12 back upward relative to power mandrel assembly 176, the frictional engagement of upper and lower sliding O-ring seals 198 and 200 with the exterior surface 190 of lower power mandrel 182 will cause the bypass sleeve 196 to be frictionally held in a closed position thereafter.

Figure 1H:
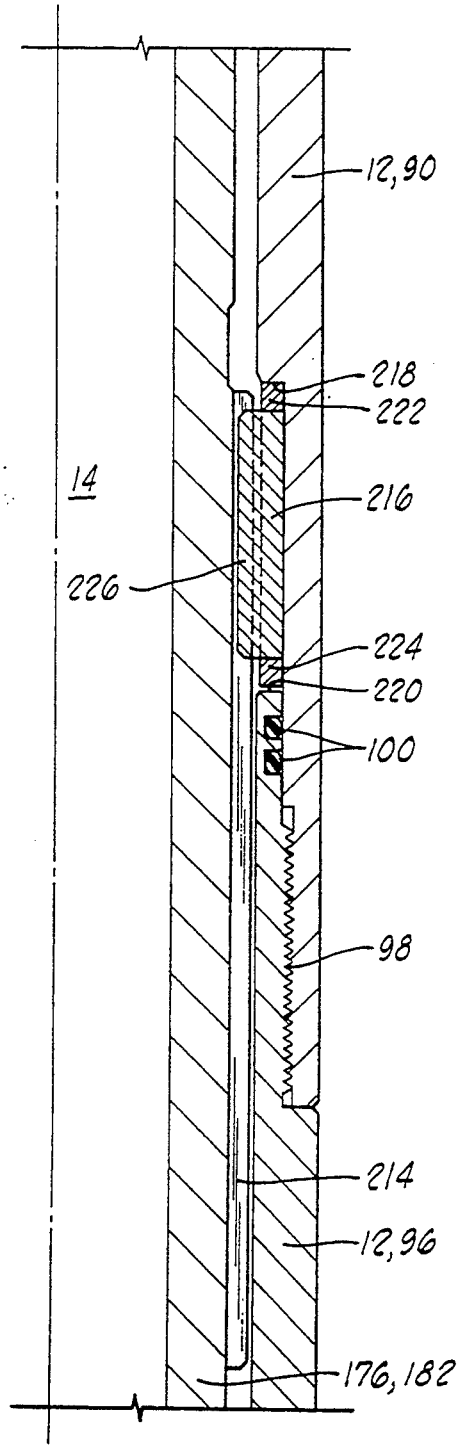
Figure 1I:
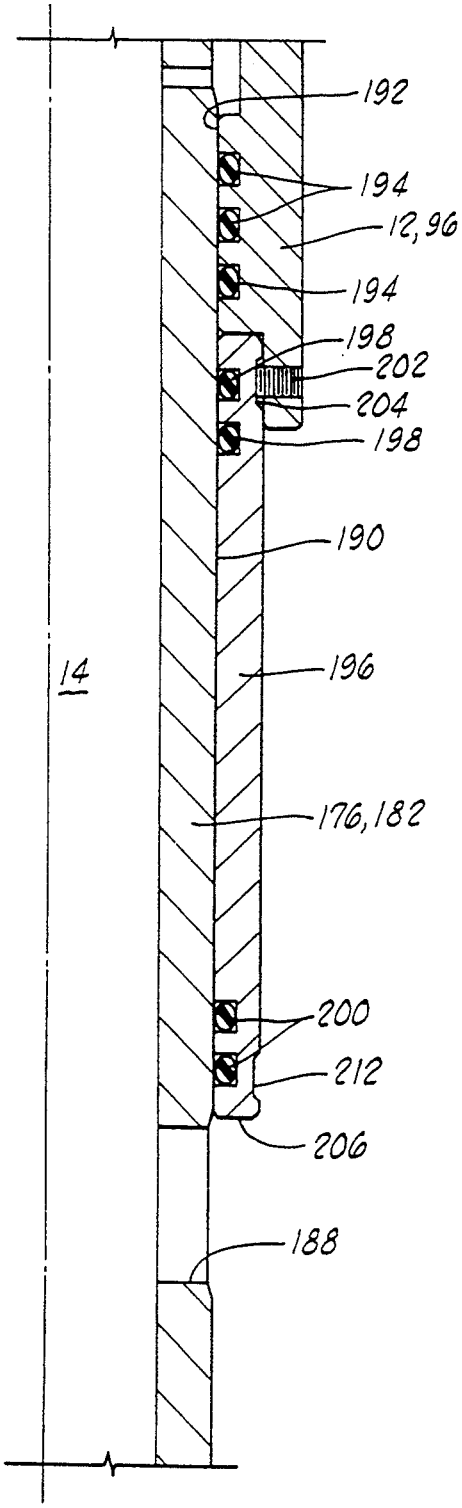
Figure 1J:
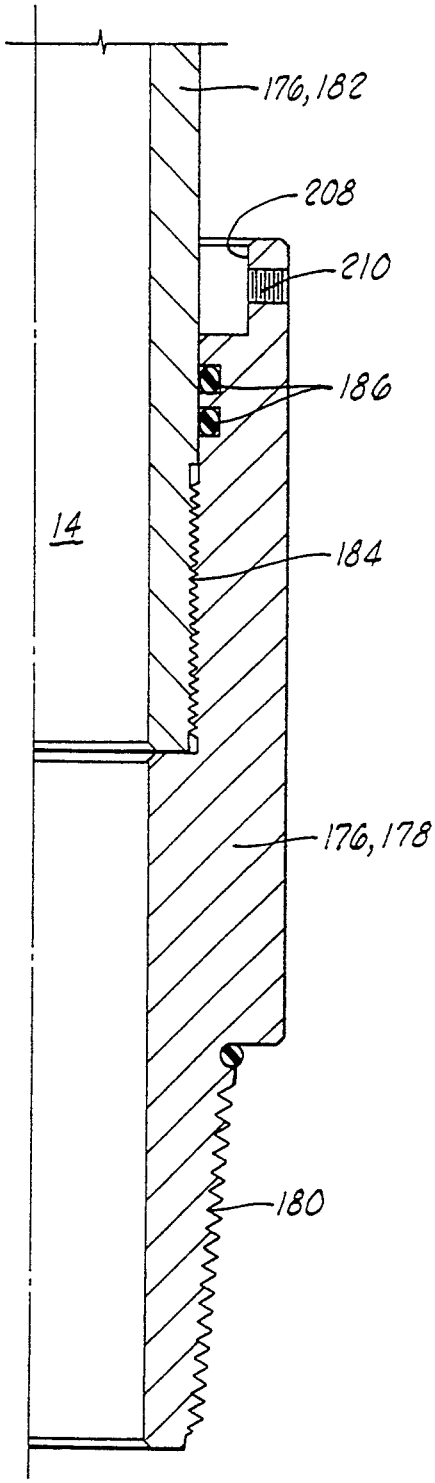

The lower power mandrel 182 has an endless J-slot 214 formed in an exterior portion thereof as seen in FIG. 1H. The details of J-slot 214 are best seen in the laid-out view of FIG. 2.

An annular ring 216 is carried by housing 12 between a downward facing shoulder 218 of lug case 90 and an upper end 220 of lower housing case 96. Ring 216 rotates between upper and lower bearings 222 and 224. A lug 226 extends radially inward from ring 216 and is received within J-slot 214 to control the relative motion between power mandrel assembly 176 and housing 12 in a manner further described below.

Power mandrel assembly 176 further includes an upper power mandrel 226 which is connected to lower power mandrel 182 by a power mandrel connector 228. Connector 228 is connected to lower power mandrel 182 at thread 230 and to upper power mandrel 226 at thread 232. Connector 228 has a cylindrical outer surface 234 closely received within a lower cylindrical inner surface 236 of equalizing case 78 with a plurality of O-ring seals therebetween designated as 238.

An annular cavity 240 is defined between upper power mandrel 226 and equalizing case 78. An annular floating piston 242 is received therein and has inner seal 244 sealing against upper power mandrel 226 and outer seal 246 sealing against equalizing case 78.

An upper portion of the upper mandrel 226 is closely received within a bore 248 of upper fill port adapter 47 as seen in FIG. 1D, with a plurality of O-ring seals 250 received therebetween. An irregular shaped, generally annular oil chamber 252 is defined between upper power mandrel 226 and housing 12 and has an upper extent defined by seals 250 and a lower extent defined by the seals 244 and 246 of floating piston 242. The oil chamber 252 is filled with hydraulic oil through fill ports 52 and 74 during assembly of the tool 10.

The upper end of upper mandrel 226 is received through a bore 254 of lower operating mandrel cap 172. The upper end of upper collar mandrel 226 has an upper end cap 256 threadedly connected thereto at thread 258.

The Hydraulic Time Delay

As seen in FIG. 1E, an annular metering piston 260 is threadedly connected to upper power mandrel 226 at thread 262. The metering piston 260 divides the oil chamber 252, which can also be referred to as metering chamber 252, into first and second portions 264 and 266 above and below metering piston 260, respectively.

Metering piston 260 has a fluid passage 268 disposed therethrough joining the first and second portions 264 and 266 of metering chamber 252. A flow impedance means 270 is disposed in fluid passage 268. The flow impedance means 270 is preferably a commercially available hydraulic insert sold under the designation "LEE VISCO JET" by The Lee Company of Westbrook, Conn. Various configurations of "LEE VISCO JET" flow restriction devices can be specified and installed in passage 268 to provide a predetermined amount of fluid resistance to fluid flow through passage 268. Passage 268 has a lateral opening 272 at its lower end which is opened radially inward toward upper power mandrel 226. The upper power mandrel 226 is undercut as shown at 274 to provide an annular pathway 276 which is part of the lower portion 266 of metering chamber 252. A pair of O-ring seals 278 seals between metering cartridge 260 and upper power mandrel 226 above the undercut 274.

The upper extension sleeve 68 of lower fill port adapter 62 of housing 12 has a cylindrical bore 280 defined therein which can also be referred to as a cylindrical housing seal bore 280.

The metering piston 260 carries a one-way O-ring seal means 282 disposed thereabout for sealing between metering piston 260 and the housing seal bore 280 when the power mandrel assembly 176 slides upward, in what may generally be referred to as a first direction, relative to housing 12 so that fluid from the upper first portion 264 of metering chamber 252 must flow through the fluid passage 268 to the second lower portion 266 of metering chamber 252.

The one-way O-ring seal means 282 also provides a means for providing a bypass between the metering piston 260 and the housing seal bore 280 when the power mandrel assembly 176 moves downward, in what can generally be referred to as a second direction, relative to the housing 12. This is accomplished as follows.

The metering piston 260 has an outer annular groove 284 defined therein with the one-way O-ring seal means 282 being received in groove 284. The groove 284 has a shallower portion 286 and a deeper portion 288. The deeper portion 288 is adjacent the shallower portion 286 and is located above, i.e., in said first direction, from the shallower portion 286. A tapered portion 285 joins shallower portion 286 and deeper portion 288.

The one-way O-ring seal means 282 is located in the shallower portion 286 of groove 284 as shown in FIG. 1E when the power mandrel 176 moves upward relative to housing 12. When the power mandrel 176 moves downward relative to housing 12, however, the O-ring 282 will roll into the deeper portion 288 of groove 284 and thus out of sealing engagement with housing seal bore 280 thus allowing fluid in metering chamber 252 to flow through the thin annular space between metering cartridge 260 and housing seal bore 280.

The O-ring 282 is sized so that there is more squeeze or compression on the outside diameter of the ring 282 than on the inside diameter of the ring 282 thus causing the O-ring 282 to be drawn into the sealing position in the shallower portion 286 of groove 284 when the metering piston 260 moves upward relative to housing 12.

The upper extension sleeve 68 of housing 12 has a dump passage means 290 defined therein for dumping fluid from the upper portion 264 of metering chamber 52 to the lower portion 266 of metering chamber 252 after the metering piston 260 has moved past a predetermined position relative to housing 12. The predetermined position is the position at which the one-way O-ring seal means 282 first moves above dump passage 290 so that hydraulic fluid can flow through a thin annular clearance 292 between upper extension sleeve 268 and an inner bore 294 of metering chamber case 58.

The housing 12 can generally be described as having an outer housing member 58 and an inner housing sleeve 68 received in the outer housing member 58 with the annular space 292 defined between the outer housing member 58 and the inner housing sleeve 68. The annular space 292 is open at its upper end to the upper portion 264 of metering chamber 252. The dump passage 290 is a radial bore defined through the inner housing sleeve 260 and communicates the annular space 292 with the housing seal bore 280.

The apparatus 10 is shown in FIGS. 1A–1J in its fully extended position with the ball valve element 104 closed as it would normally be when the tool 10 is run into a well. As previously mentioned, the tool 10 is part of the testing string which includes a packer (not shown) which will be attached to power mandrel assembly 176 for sealing against a well bore (not shown). This packer means typically will be designed to be set within the well bore by setting weight down on the packer means.

The metering piston 260 provides a time delay means for allowing this weight to be set down on the packer means to set the packer within the well bore without moving the power mandrel assembly 176 sufficiently upward within housing 12 to open the ball valve member 104.

After the packer has been set, the ball valve element 104 can then be opened by setting down weight on the test string. This will cause the housing 12 to begin to move downward relative to power mandrel assembly 176 which is held in a fixed position by the packer which has been set within the well bore. The fluid flow restriction 270 will impede the flow of hydraulic fluid from upper portion 264 of metering chamber 252 down through passage 268 to lower portion 266 of metering chamber 252. Typically the fluid flow restriction 270 will be chosen to provide approximately a two minute time delay for movement of the housing 12 downward sufficiently to open the ball valve element 104. The housing 12 will move downward very slowly until the one-way O-ring seal means 282 moves above the dump passage 290 at which time the housing 12 will move downward very rapidly to open the ball valve element 104. This rapid movement is permitted by the ease with which hydraulic fluid can flow downward through the annular space 292, then through the dump passage 290 below the one-way O-ring seal means 282. Thus the final downward movement of housing 12 relative to power mandrel assembly 176 will be very rapid. The upper end cap 256 of power mandrel assembly 176 will sharply impact the operating mandrel assembly which moves the ball valve element 104 to its open position.

If the rapid final opening motion of the ball valve element is not required or desired, it can be eliminated by eliminating the dump passage 290 so that the entire opening motion of the ball valve will occur slowly. It is generally desired to quickly open the ball valve, however, to prevent erosion of ball valve element 104 during the transition time.

The action of the hydraulic metering system when weight is set down on the tool 10 can be summarized as follows. Drill pipe weight will be slacked off enough to set the packer; normally, thirty thousand pounds will be slacked off on the weight indicator at the surface. Initially, the hydraulic time delay metering system in tool 10 will transmit this weight through the tool 10 to set the packer. After some time has passed and the packer has been set, the metering system will allow bypass port 188 to be closed. Then the ball valve element 104 will be opened. As the O-ring 282 passes dump port 290, metering will stop and the tool will "jump" to the fully open position of ball valve element 104 thus creating a "jiggle" in the pipe string at the surface indicating that the tester valve is open.

The various surfaces of housing 12 and power mandrel assembly 176 which are acted upon by internal and external hydraulic pressure are preferably dimensioned so that the tool 10 will be hydraulically balanced when run either with or without an accompanying slip joint. The equalizing port 86 causes the hydraulic fluid in lower portion 266 of metering chamber 252 to be at well annulus pressure and also is an integral part of the balancing of the tool 10.

Shock Absorber And Tolerance Adjustment Device

As seen in FIG. 1C, a shock absorber and tolerance adjuster means 296 is provided between the operating assembly and the power mandrel assembly 176. The operating assembly can be considered to include the ball valve element 104, and the various apparatus attached thereto such as upper operating mandrel 166 and lower operating mandrel 168.

The shock absorber means 296 has an inner sleeve 298 having a cylindrical outer surface 300. The shock absorber means 296 also has an outer sleeve 302 comprised of the upper and lower operating mandrels 166 and 168, respectively. Sliding motion is permitted between inner sleeve 298 and outer sleeve 302.

The outer sleeve 302 can be described as having a cylindrical inner surface 304 concentrically disposed about and radially spaced from the cylindrical outer surface 300 of inner sleeve 298 to define an annular chamber 306 therebetween.

The inner and outer sleeves 298 and 302 can further be described as having first and second longitudinally facing shoulders 308 and 310, respectively, facing toward each other to define opposite longitudinal ends of the annular chamber 306.

The chamber 306 can be described as having a constant radial thickness defined by the radial spacing between cylindrical outer surface 300 and cylindrical inner surface 304. The chamber 306 can also be described as having a variable length 312 defined by a longitudinal distance between the first and second shoulders 308 and 310.

The shock absorber means 296 includes an elastomeric shock absorber ring 314 disposed in the chamber 306. Shock absorber ring 314 has a round cross-sectional shape as seen in FIG. 1C when it is in an unconfined or undeformed position. The shock absorber ring 314 is preferably chosen to have dimensions such that when received in chamber 304 with the chamber 304 in its fully extended position as shown in FIG. 1C, the ring 304 will contact outer cylindrical surface 300, inner cylindrical surface 304, and first and second shoulders 308 and 310. The lower operating mandrel 168 carries a radially inward protruding annular flange 316 which is positioned to determine an initial position, which may also be referred to as a fully extended position, of inner sleeve 298 relative to outer sleeve 302 as shown in FIG. 1C. A lower end 318 of inner sleeve 298 abuts flange 316 when the inner sleeve 298 is in its initial fully extended position. The shock absorber ring 314 contacts both the first and second shoulders 306 and 308 when the shoulders are separated by their maximum longitudinal distance 312 as determined by engagement of the lower end 318 of inner sleeve 298 with flange 316 of outer sleeve 302.

The position shown in FIG. 1C can also be described as a position wherein the elastomeric shock absorber ring 314 initially contacts the first and second shoulders 308 and 310 with the longitudinal distance 312 therebetween. The shock absorber ring 314 is chosen so that it has a volume when in the position illustrated in FIG. 1C less than a volume of the chamber 306.

It will be appreciated that as inner sleeve 298 moves upward relative to outer sleeve 302, the distance 312 will decrease and the volume of chamber 306 will decrease. In the embodiment illustrated in FIG. 1C, the possible travel of inner sleeve 298 relative to outer sleeve 302, but for the shock absorber ring 314, is determined by a gap 320 between an upper end 322 of inner sleeve 298 and a downward facing shoulder 324 of upper operating mandrel 166. The permissible travel or gap 320 is chosen so that it is greater than the travel which will be permitted by the relative volumes of chamber 306 and shock absorber ring 314. As the inner sleeve 298 moves upward relative to outer sleeve 302, and as the volume of chamber 306 decreases, the shock absorber ring 314 will be deformed from its initial round cross-sectional shape and it will flow generally like a fluid to fill the square cross-sectional shape of chamber 306. The shock absorber ring 314 is made of a flexible but substantially incompressible elastomer so that the ring 314 can deform to fill chamber 306 and so that the shock absorber ring 314 will then prevent further closing motion between the inner and outer sleeves 298 and 302 after the shock absorber ring 314 completely fills chamber 306.

Thus although the shape of shock absorber ring 314 changes, the volume filled by shock absorber ring 314 does not substantially change due to its incompressibility.

The relative volumes of shock absorber ring 314 and chamber 306, and the distance or gap 320 are chosen so that the shock absorber ring 314 will completely fill chamber 306 and stop further upward movement of inner sleeve 298 before the upper end 322 of inner sleeve 298 engages the shoulder 324 of outer sleeve 302. The deformation of the shock absorber ring 314 will serve to resiliently absorb a substantial amount of the impact of upper end cap 256 of power mandrel assembly 176 against the lower end 318 of inner sleeve 298 of shock absorber means 296, during the motion of opening the ball valve 104.

Further, there is a sufficiently close sliding fit between outer surface 300 of inner sleeve 298 and an inner cylindrical surface 326 of upper operating mandrel 166 and between inner cylindrical surface 304 of outer sleeve 302 and an outer cylindrical surface 328 of inner sleeve 298 so as to prevent extrusion of the elastomeric shock absorber ring 314 from the chamber 306.

The shock absorber means 296 also provides a second function, namely to accommodate manufacturing tolerances in the tool 10, and particularly in the length of power mandrel assembly 176 and the operating assembly including upper and lower operating mandrels 166 and 168. It will be appreciated that the relative lengths of the various components of tool 10 must be kept within fairly close tolerances in order that the tool will operate in its intended fashion. Due to the large number of components which must be fabricated and connected together to form the power mandrel assembly 176 and the operating assembly, it is desirable to provide a means for accommodating some increased tolerance in the length of the assembled components. This is provided by the shock absorber means 296 which due to the variability of the length 312 can accommodate tolerances in length of the operating assembly and power mandrel assembly within the scope of variability of length 312.

For example, in one embodiment of the present invention having a chamber 306 of initial dimensions of approximately 0.41 inches square in cross section as seen in FIG. 1C, the shock absorber ring 314 is chosen so that it provides a maximum reduction in length 312 of 0.09 inches before the shock absorber ring 314 completely fills chamber 306. In that example, the total movement of the power mandrel assembly 176 from a fully extended position corresponding to the closed position of ball valve member 104 to a fully telescopingly collapsed position corresponding to an open position of a ball valve member 104 is 4.12 inches. The 0.09 inch tolerance provided by shock absorber means 296 will accommodate tolerances in the lengths of the power mandrel assembly 176 and the operating assembly, and also provides a shock absorber to absorb the impact of the rapid opening motion provided due to the dump passage 290.

It will be appreciated that the shock absorber and time delay means 296 could be incorporated in other types of downhole tools other than the reciprocating action full opening ball tester valve illustrated. For example, the shock absorber and tolerance adjuster means 296 could be utilized with annulus pressure responsive tools wherein the operating motion is achieved by increasing well annulus pressure to move a power mandrel due to a pressure differential across a power piston.

The J-Slot And Lug Assembly

As shown in FIG. 1H, the housing 12 and power mandrel assembly 176 are interconnected by the lug 226 and J-slot 214. This lug and J-slot arrangement provides two features. First, it prevents relative rotational movement between housing 12 and power mandrel assembly 176 thus allowing torque to be transferred through the tool 10. Second, the lug and J-slot assembly controls relative reciprocating motion between housing 12 and power mandrel assembly 176 in a manner so as to permit the ball valve 104 to be temporarily locked in a closed position.

It will be appreciated that in the absence of the lug and J-slot arrangement, such as for example in a tool like that shown in U.S. Pat. No. 4,579,174 to Barrington, the ball valve element 104 will be open when the tool is in tension as when it is normally run into a well, and the ball valve element 104 will be closed when compressional forces are applied across the tool 10 for sufficient time to overcome the time delay means and to move the housing 12 downward relative to power mandrel assembly 176. That of course is normally done only after the packer located below tool 10 has been set within the well bore, and weight has been set down on the test string to open the tester valve element 104. Normally thereafter when weight is again picked up from the test string, the tester valve 10 will very quickly extend to its extended position with the ball valve element 104 again closed. If weight is again set down, the ball valve element will again open after the predetermined time delay. In some instances, however, it may be desirable to be able to pick up weight from the test string to reclose the ball valve, and to subsequently set weight down again on the packer without reopening the ball valve. This can be accomplished with the lug and J-slot arrangement shown in the following manner.

Figure 2:
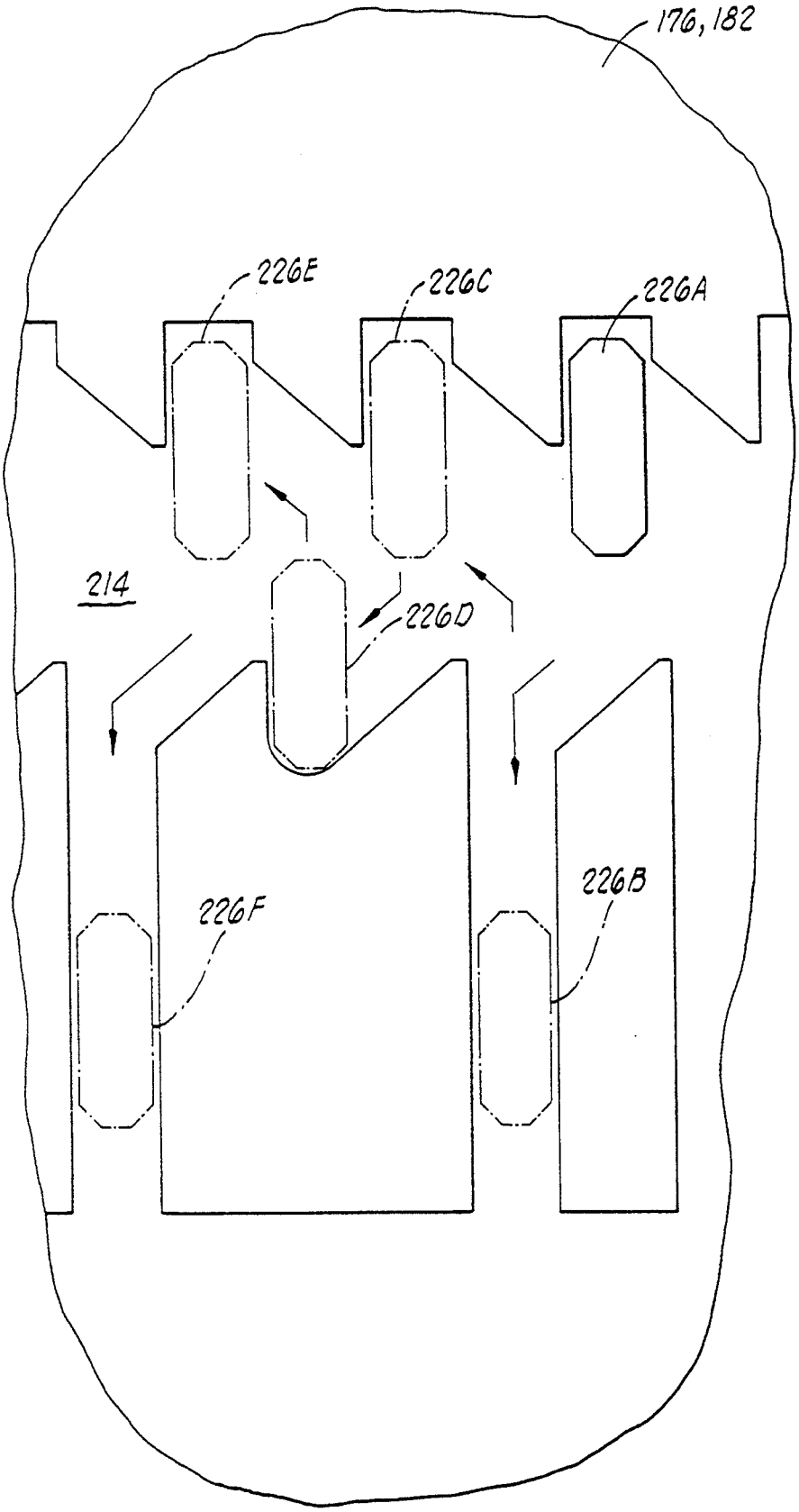
FIG. 2 is a laid-out view of the J-slot of the tester valve of FIG. 1H.

FIG. 2 provides a laid-out view of a portion of the J-slot 214. The lug 226 is shown in solid lines in a position corresponding to a closed position of ball valve 104 and corresponding to the position of lug 226 seen in FIG. 1H. The position of lug 226 shown in solid lines in FIG. 2 is designated as 226A.

After the packer connected to power mandrel assembly 176 has been set within the well bore, weight will be set down on the test string so as to move the housing 12 downward relative to power mandrel assembly 176. When this occurs the lug 226 will move down to the position shown in phantom lines and designated as 226B which is an open position of the ball valve element 104.

When weight is again picked up from the test string the housing 12 will move upward relative to power mandrel assembly 176 thus moving the lug 226 up to a second closed position designated in phantom lines as 226C.

The next time weight is set down on housing 12, the lug 226 will move downward to a locked closed position 226D in which the ball valve member 104 is held closed even though weight is set down on the tool 10. The next upward motion of housing 12 relative to power mandrel assembly 176 caused by picking up weight on the test string will move the lug 226 to a closed position designated in phantom lines as 226E.

Then the next time weight is set down on housing 12 for sufficient time to overcome the time delay means, the lug 226 will move down to the next open position 226F wherein the ball valve member 104 will again be open.

The portion of J-slot 214 shown in FIG. 2 is slightly more than one-half of the entire J-slot 214. It will be appreciated that the J-slot 214 is an endless J-slot so that the pattern of operations just described can be endlessly repeated. The next position after phantom line position 226F will correspond to the initial position 226A except that the lug will be located 180° about power mandrel assembly 176 from the position 226A.

The lug and J-slot arrangement can be generally described as a J-slot and lug means operatively connecting the power mandrel assembly 176 and housing 12 for locking the spherical valve member 104 in its closed position for at least one reciprocating telescoping cycle of the power mandrel assembly 176 relative to the housing 12. The J-slot and lug means can be further characterized as a means for automatically locking the spherical valve member 104 in its closed position on alternating telescoping cycles of the power mandrel assembly 176 relative to the housing 12.

The J-slot and lug assembly further provides a means for allowing weight to be set down on a packer located below the tool 10 while maintaining the spherical valve member 104 in its closed position.

Thus it is seen that the apparatus of the present invention readily achieves the ends and advantages mentioned as well as those inherent therein. While certain preferred embodiments of the invention have been illustrated and described for purposes of the present disclosure, numerous changes in the arrangement and construction of parts may be made by those skilled in the art, which changes are encompassed within the scope and spirit of the present invention as defined by the appended claims.

What is claimed is:

1. A downhole tool apparatus, comprising:

a tool housing;

an operating assembly disposed in said housing;

a mandrel longitudinally movable in said housing to engage and operate said operating assembly; and a shock absorber means for absorbing an impact between said mandrel and said operating assembly, said shock absorber means including:

an inner sleeve having a cylindrical outer surface;

an outer sleeve, slidable relative to said inner sleeve, and having a cylindrical inner surface concentrically disposed about and radially spaced from said cylindrical outer surface of said inner sleeve to define an annular chamber therebetween;

said inner and outer sleeves having first and second longitudinally facing shoulders, respectively, facing toward each other to define opposite longitudinal ends of said annular chamber, said chamber having a constant radial thickness defined by the radial spacing between said cylindrical inner surface and said cylindrical outer surface, and said chamber having a variable length defined by a longitudinal distance between said first and second shoulders;

an elastomeric shock absorber ring disposed in said chamber and having a volume less than a volume of said chamber when said longitudinal distance between said first and second shoulders is such that said elastomeric shock absorber ring initially contacts both said first and second shoulders; and said inner and outer sleeves having sufficient possible travel relative to each other such that a closing motion between said first and second sleeves is limited when said volume of said chamber is equal to said volume of said elastomeric shock absorber ring so that said elastomeric shock absorber ring completely fills said chamber thus resiliently terminating said closing motion and absorbing said impact.

2. The apparatus of claim 1, wherein:

said elastomeric shock absorber ring has a round cross-sectional shape when in an unconfined position.

3. The apparatus of claim 1, wherein:

said elastomeric shock absorber ring is made of a flexible but substantially incompressible elastomer so that said ring can deform to fill said chamber and then prevents further closing motion between said inner and outer sleeves.

4. The apparatus of claim 1, wherein:

said inner and outer sleeves have a sufficiently close sliding fit to each other as to prevent extrusion of said elastomeric shock absorber ring from said chamber.

5. The apparatus of claim 1, further comprising:

initial positioning means for defining a maximum longitudinal distance between said first and second longitudinally facing shoulders; and wherein said elastomeric shock absorber ring contacts both said first and second longitudinally facing shoulders when said shoulders are separated by said maximum longitudinal distance.

6. The apparatus of claim 1, wherein:

said shock absorber means provides a means for accommodating allowable manufacturing tolerances in a length of said mandrel.

* * * * *